US008985239B1

(12) United States Patent
Akerman

(10) Patent No.: US 8,985,239 B1
(45) Date of Patent: Mar. 24, 2015

(54) DRILLING DERRICK AND APPARATUS BASE ASSEMBLY

(76) Inventor: Steve Akerman, Purcell, OK (US)

( * ) Notice: Subject to any disclaimer, the term of this patent is extended or adjusted under 35 U.S.C. 154(b) by 661 days.

(21) Appl. No.: 13/374,802

(22) Filed: Jan. 14, 2012

Related U.S. Application Data

(60) Provisional application No. 61/461,920, filed on Jan. 25, 2011.

(51) Int. Cl.

| | |
|---|---|
| ***B21B 19/00*** | (2006.01) |
| ***E21B 7/02*** | (2006.01) |
| ***E21B 17/07*** | (2006.01) |
| *E21B 19/00* | (2006.01) |

(52) U.S. Cl.
CPC *E21B 17/07* (2013.01); *E21B 19/00* (2013.01)
USPC ..... 173/185; 173/184

(58) Field of Classification Search
CPC ..... E21B 17/07; E21B 19/00; E21B 7/02
USPC ..... 173/184, 185
See application file for complete search history.

(56) References Cited

U.S. PATENT DOCUMENTS

| | | | |
|---|---|---|---|
| 4,016,687 | A | 4/1977 | Griffith |
| 4,024,924 | A | 5/1977 | Houck |
| 4,393,630 | A | 7/1983 | Knox |
| 4,447,977 | A | 5/1984 | Holmgren |
| 4,465,144 | A | 8/1984 | Gugger |
| 4,478,291 | A | 10/1984 | Futros |
| 4,585,213 | A | 4/1986 | Slagle, Jr. |
| 4,590,720 | A | 5/1986 | Reed |
| 4,753,300 | A | 6/1988 | Shaw |
| 4,757,592 | A | 7/1988 | Reed |
| 4,932,175 | A | 6/1990 | Donnally |
| 5,450,695 | A | 9/1995 | Desai |
| 5,697,457 | A | 12/1997 | Back |
| 5,794,723 | A | 8/1998 | Caneer, Jr. |
| 6,112,834 | A | 9/2000 | Barrett |
| 6,336,622 | B1 | 1/2002 | Eilertsen |
| 6,412,576 | B1 | 7/2002 | Meiners |
| 6,913,096 | B1 | 7/2005 | Nielsen |
| 2009/0272540 | A1 | 11/2009 | Rodgers |

*Primary Examiner* — Michelle Lopez
(74) *Attorney, Agent, or Firm* — Randal D. Homburg

(57) ABSTRACT

An improved base structure for a derrick mast of a pivotal portable drilling rig structure provides at least two A-frame support members affixed to a rig side of the derrick mast, the drilling rig structure being elevated to a point slightly forward from vertical position towards a well side, with the A-frame support members held in a drilling position by respective support member stanchions which apply static force below the A-frame support members during use of the drilling rig structure applying enhanced drilling forces and stability applied during the drilling process. A rig side secondary locking support structure secured to an elevating drilling rig platform provides additional stability to the drilling rig structure when the drilling rig is in an operational position subsequent to the positioning of the A-frame support members and the support member struts.

8 Claims, 13 Drawing Sheets

DRILLING DERRICK AND APPARATUS BASE ASSEMBLY

CROSS REFERENCE TO RELATED APPLICATIONS

Applicant claims the benefit of Provisional Patent Application No. 61/461,920, filed on Jan. 25, 2011, filed by the same inventor.

I. BACKGROUND OF THE INVENTION

1. Field of Invention

An improved base structure for a lower mast of a pivotal drilling rig structure provides at least two A-frame support members affixed to the rig side of the lower mast, the drilling rig structure being elevated to a point slightly forward from vertical position towards the well side, with the A-frame support members held in a drilling position by respective support member struts which apply force against the A-frame support members during use of the drilling rig structure to enhance the drilling forces applied during the drilling process. A rig side secondary locking support structure secured to an elevating drilling rig platform provides additional stability to the drilling rig structure when the drilling rig is in an operational position subsequent to the positioning of the A-frame support members and the support member struts.

2. Description of Prior Art

A preliminary review of prior art patents was conducted by the applicant which reveal prior art patents in a similar field or having similar use. However, the prior art inventions do not disclose the same or similar elements as the present improved derrick and associated apparatus, nor do they present the material components in a manner contemplated or anticipated in the prior art.

In U.S. Patent Application No. 2009/0272540 to Rodgers, a mobile hydraulic work-over rig is disclosed, which includes a rig having a derrick elevated on a base structure comprising containers for equipment used in association with the drilling or work-over activity, a work platform including pipe rack sections for storing pipe, with the derrick being open sided with a power cylinder at an upper end for lifting and lowering pipe section away from and into each well, and hydraulic drive cylinders for advancing the rig between wells without telescoping or pivoting the derrick into a travel position, all of the hydraulic components being operated from a central control panel on the work platform.

Telescoping derricks on workover rigs are disclosed in U.S. Pat. No. 7,461,831 to Mosley, U.S. Pat. No. 5,450,695 to Desai, U.S. Pat. No. 4,932,175 to Donnally, U.S. Pat. No. 4,590,720 to Reed, and in U.S. Pat. No. 4,969,776 to Bunce. More specifically, Bunce discloses an offshore rig with has extendable caissons with a topside platform, the caissons extending to the bottom of the sea floor, providing a stable working platform. Reed has a plurality of element which telescope one into another so that the derrick can be raised from a short collapsed position into an extended position by the use of four cables, one in each corner of the derrick. Donnally is a telescoping derrick that is light for easy transport and uses structure to enable the mast to be raised from a collapsed horizontal position to a vertical position by hydraulic cylinders, the mast in an retracted position and later the being telescopically raised to full height by a cable means. Mosley is relatively similar to Donnally and also the Rodgers assembly. A very established collapsible derrick tower, using a cable hoist, is disclosed in U.S. Pat. No. 1,299,261 to Taylor.

In U.S. Pat. No. 5,161,639 to Ice, a telescoping rig is disclosed having a safety line attached to the crown which is used to secure a worker within a harness while climbing up the derrick tower. This harness device includes a counterweight within a telescoping tube. This derrick, which is not indicated on a portable rig also appears to have two lower support fins although no function is noted for these lower fins.

Other patents indicate features in prior art which are hereby disclosed and improved in the present derrick and apparatus, including U.S. Pat. No. 5,697,457 to Back, which provides a drilling derrick or mast transported on a trailer of a vehicle, which is raised into a vertical position using a pivotal means and a hydraulic ram to elevate the derrick or mast from a horizontal transport position tot a vertical drilling position. In U.S. Pat. No. 4,757,592 to Reed, a method is disclosed which provides a jacking crane erecting four telescoping hydraulically powered legs used to erect a "two spaced parallel column drilling derrick." This is built upon a mud sled platform which provides a secure stable platform upon which to build the drilling derrick.

A telescoping drilling rig is indicated in U.S. Pat. No. 4,932,175 to Donnally which involves a substructure pivotally connecting a lower mast section which is raised and lowered between a horizontal position and a vertical position by a power means (cable), FIG. 5, and an upper mast section being in sliding engagement with the lower mast section, FIGS. 6-7, and a guide assembly for connection between the upper and lower mast sections with foot for securing the upper mast section for telescoping movement within the guide assembly as indicated in FIGS. 2 and 4.

A variety of different A-frame structures utilized in the base of a drilling rig are demonstrated in several patents, including U.S. Pat. No. 5,794,723 to Caneer, Jr., U.S. Pat. No. 4,465,144 to Gugger, U.S. Pat. No. 4,447,997 to Delgado and U.S. Pat. No. 4,024,924 to Houck. In Houck, the A-frame is a stationary stop attaching to a table structure, which is used to buttress a standing vertical derrick. A quite similar situation is disclosed in the Delgado patent, where the A-frame is erected and affixed to the floor of the drilling rig and a vertical cable is used to raise the derrick from a horizontal position into a vertical position, with the A-frame providing a locking attachment for the derrick to maintain the vertical position. In Gugger, an A-frame structure is mounted to the rear of the derrick trailer, with the upper end of the A-frame being pivotally attached to the derrick while a piston ram elevates the derrick from a horizontal transport position to a vertical drilling position, with the derrick further held into position by a plurality of wedges or locking pins at the upper end of the A-frame and the lower end of the A-frame. A somewhat similar inclusion of an A-frame support component is used in the Caneer, Jr., apparatus.

Use of a top drive drilling component on a vertical drilling rig is demonstrated in several drilling rig patents, including U.S. Pat. No. 7,828,086 to Lesko, U.S. Pat. No. 7,290,621 to Orr, U.S. Pat. No. 6,913,096 to Nielsen, U.S. Pat. No. 6,412,576 to Meiners U.S. Pat. No. 6,336,622 to Eilertsen U.S. Pat. No. 6,112,834 to Barrett, U.S. Pat. No. 4,753,300 to Shaw, and U.S. Pat. No. 4,478,291 to Futros, with these top drive mechanisms developed for practical use in the oil fields in the 1980's, even though conceived as early as the 1920's, to overcome the limitations of rotary table drilling systems. These top drive systems provided a means of drilling an entire stand of drill pipe, or multiple single strands of pipe connected together, where the rotary table drilling only provided for the drilling of a single pipe strand at one time. over time, these top drive assemblies have also provided the ability to deliver drilling mud and chemicals to the drilling stem. These top drive assemblies have had difficulty with handling the connection and disconnection of drill pipe, but the moving and handling of stands of drill pipe. Another problem with top drive assemblies is that they do not efficiently provide stability against great rotational force torques sometimes applied to them while being used with a hydraulic drilling system, the higher torque being used for deeper wells or for directional horizontal drilling. The advance of the top drive apparatus is disclosed by the top drive system employed in the present invention.

Thus, as seen in the prior art, Futros discloses a top drive connected to a chain which uses a pulley system to divert the pressure of lifting the top drive and applying drilling pressure to the base of a drilling derrick instead of the drilling pressure being forced against the top of the derrick. Eilertson indicated the use of a lifting device having rack segments which are moved up and down by using driving gear and shifting the load handles by the lifting tackle to the bottom of the derrick.

A double derrick drilling rig is disclosed in the Meiners patent which provides a top drive with two opposing guide trolleys on the ends of opposing counter-torque arms which are directed against some object on each of the two derrick towers, and presumably some type of tract, since the guide trolleys appear to have some type of four wheeled rolling means on each guide trolley. More directly, a top drive integrating within a drilling rig is the subject of the Orr patent, wherein the derrick is provided with a track system on the inner surfaces of the derrick, which may be a telescoping derrick assembly, with the top drive having a plurality of pads engaging a pair of structural guide rails comprised of a pair of rectangular tubes which extend the length of the mast of the derrick assembly. The top drive is suspended from the crown by a wire being guided over pulleys to raise and lower the top drive along the length of the mast or derrick. The top drive is locked in position along the mast by lock pins during maintenance or transport. The pads on the top drive are part of a disclosed vertical "guidance and torque reaction mechanism".

Most recently, Lesko discloses a guide rail system for a telescoping mast on a drilling rig which disclose a rail system on the inner portion of the telescoping mast having parallel guide tracks of tubular steel welded to the derrick, with the lower and upper mast sections each having these guide tracks, FIG. 8. The top drive provides an upper and lower set of track wheels facing opposing outer directions from the top drive, each wheel defining a hub, an inner ridge, a middle ridge and an outer ridge, the ridges positioned on the outer margins of the guide tracks, FIG. 9. This three ridge track wheels allow for a transition between the guide tracks of the lower mast when transferring position to the upper mast.

II. SUMMARY OF THE INVENTION

A variety of forces bear upon drilling rigs in the field. As demand increase, drilling rigs are called upon to drill wells deeper to locate product, faster because of the rapid demand of consumers and refineries, and due to the increased use of horizontal drilling techniques, longer than was once used for vertical drilling operations. Because of these demands, drilling rigs are using more powerful drilling equipment which generate increasingly greater amounts of torque forces, down hole forces and drilling head speeds, which enable the drilling rig to drill faster, deeper and longer.

As indicated previously, modern drilling rigs are also improving in safety to those working around the drilling rigs. The oilfields are moving away from drilling rigs that have the antiquated rotary floors and moving in a direction of drilling rigs that have little direct exposure of working and deck hands to the drilling equipment. Drilling rigs and equipment are increasingly hands-free and operated by a drilling operator in a control shack on the rig which uses automated machinery to conduct a large amount of the drilling operations that used to require a human presence and pose a danger to human safety. While not without risk, the dangers are being addressed and minimized. In order to increase safety and secure a drilling rig to operate as safe a possible while delivering as much stability to the increased forces being applied to the more powerful drilling rigs, the drilling rigs are requiring more stabilization to the pivotal drilling rigs, the trailer upon which the pivotal rigs are set and the elevated platform which are attached to the pivotal drilling rigs in the elevated vertical position, improvements to the support structures of the drilling rig are the objective of the improvements being addressed in the present drilling derrick and apparatus base assembly.

The primary objective of the invention is to provide a secure base comprising an A-frame support structure to the lower mast of a pivotal derrick assembly in an elevated vertical position, the A-frame support structure supported by a lower member strut which is applied between the trailer floor and the lower foot of the A-frame support structure which extends from the lower mast on the rig side of the pivotal derrick assembly, as one portion of the lower support improvement. A secondary attachment is applied to the well side of the lower mast of the pivotal derrick assembly securing the well side of the elevated pivotal derrick assembly upon the deck of an elevated drilling platform which is erected on the well side of the pivotal derrick assembly, FIG. 10. A secondary objective of the improved portable drilling apparatus lies in the rear base frame member mounted upon the trailer bed providing a high substructure to support the pivotally attaching lower derrick mast, with the lower derrick mast, upper derrick mast, crown pulley assembly and all other attached accessories being provided with a lower transport height, the overall height along the trailer in the transport position not significantly greater than the height of the rear base frame member and the lower derrick mast. This is possible due to the A-frame support being on the rear legs and actually pivoting between the upper end of the rear base frame member and the trailer bed, the A-frame support stanchion being retracted out of the way until needed for vertical support during erection or being retracted during the takedown of the portable drilling apparatus, as demonstrated in the drawing FIGS. 1, 2, 5, 6 and 12.

The drilling rig which is the subject of the disclosed improvements is generally present as a pivotal drilling rig attached to a heavy duty trailer, with a cabling system located upon the trailer near a front end and the pivotal drilling rig attached to the rear end of the trailer, the trailer being further connected to a power plant to supply electrical and hydraulic power to operated the drilling rig and its related equipment, which includes operation of the hydraulic rams used to raise and lower the pivotal derrick, to raise and lower an upper mast from within a lower mast on the telescopic drilling rigs, and to power the cable systems used to raise and lower a top drive along the extended drilling rig from the crown located on the top of the drilling rig. The top drive is the location where the drilling liquids and introduced and withdrawn during the drilling operation and it is also the location where the drill stem attached to the drill head is rotated under force. The disclosed improvements, while possible being adaptable to other drilling rigs, is not necessarily applicable within this disclosure.

III. DESCRIPTION OF THE DRAWINGS

The following drawings are submitted with this utility patent application.

FIG. 8A is a well side view of an upper derrick mast within the improved portable drilling apparatus.

FIG. 8B is a lateral side view of the upper derrick mast.

FIG. 9A is a sectional view along lines 9A/9A of FIG. 2.

FIG. 9B is a sectional view along lines 9B/9B of FIG. 2.

FIG. 9C is a sectional view along lines 9C/9C of FIG. 2.

IV. DESCRIPTION OF THE PREFERRED EMBODIMENT

Figure 1:
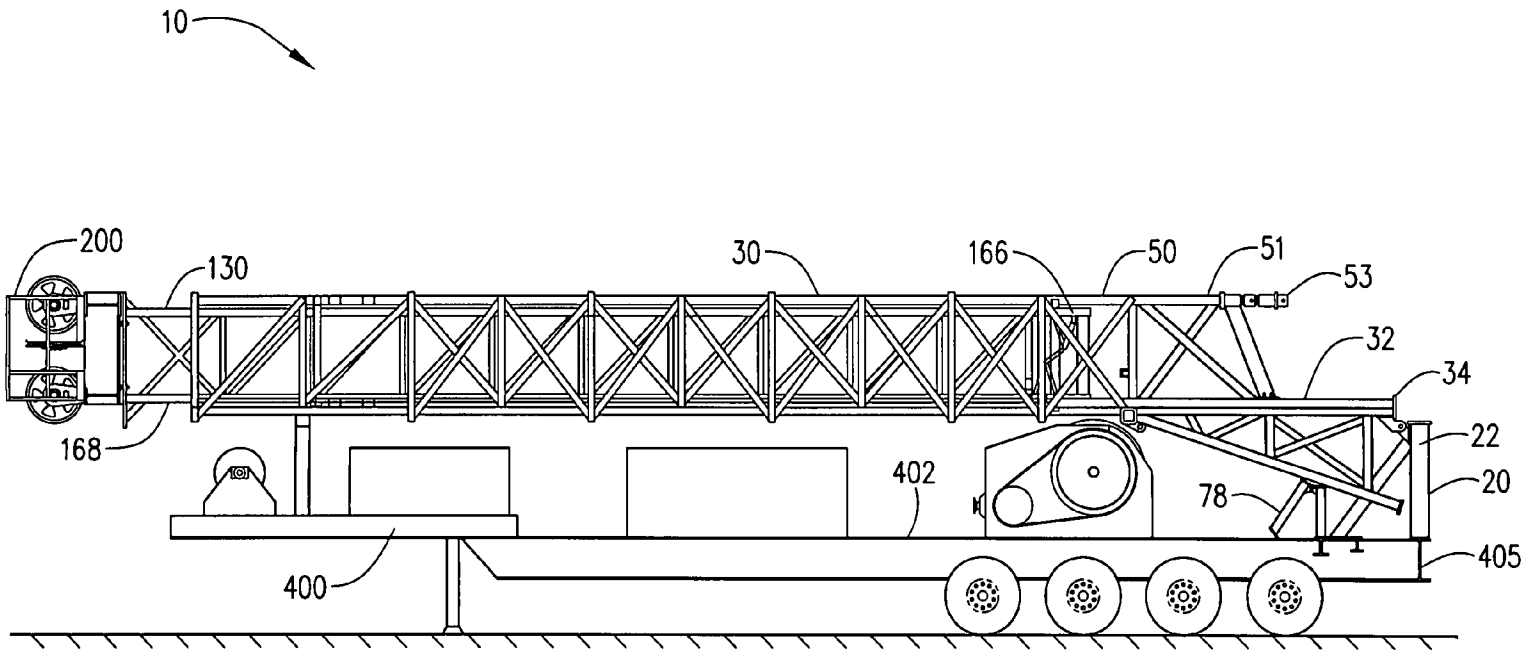
FIG. 1 is a side view of an improved portable drilling apparatus on a trailer with the improved portable drilling apparatus in a horizontal transport position.
Figure 2:
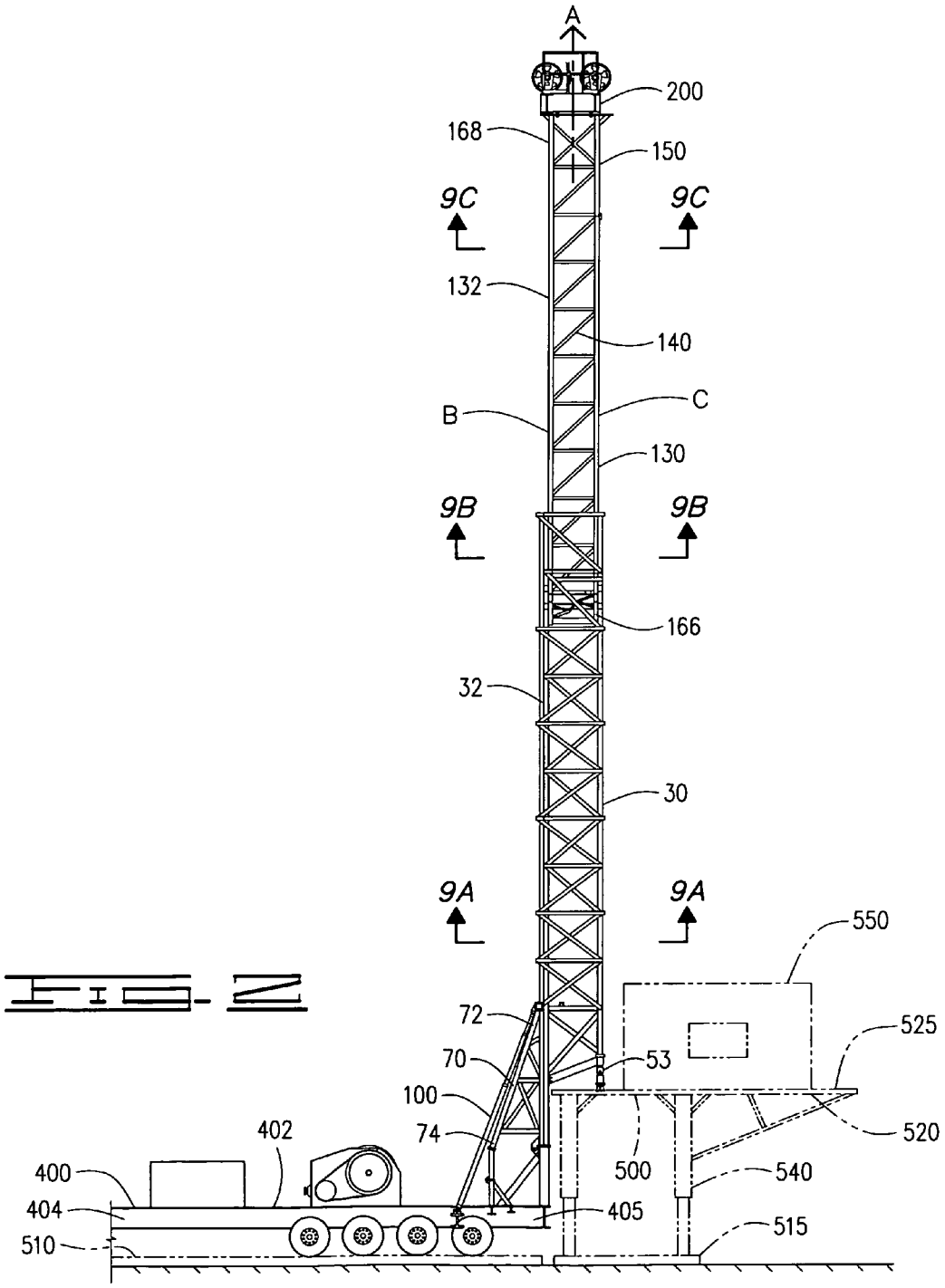
FIG. 2 is the improved portable drilling apparatus on the trailer in the vertical operational position in operational relationship to an extendable platform assembly, shown by phantom lines.
Figure 11:
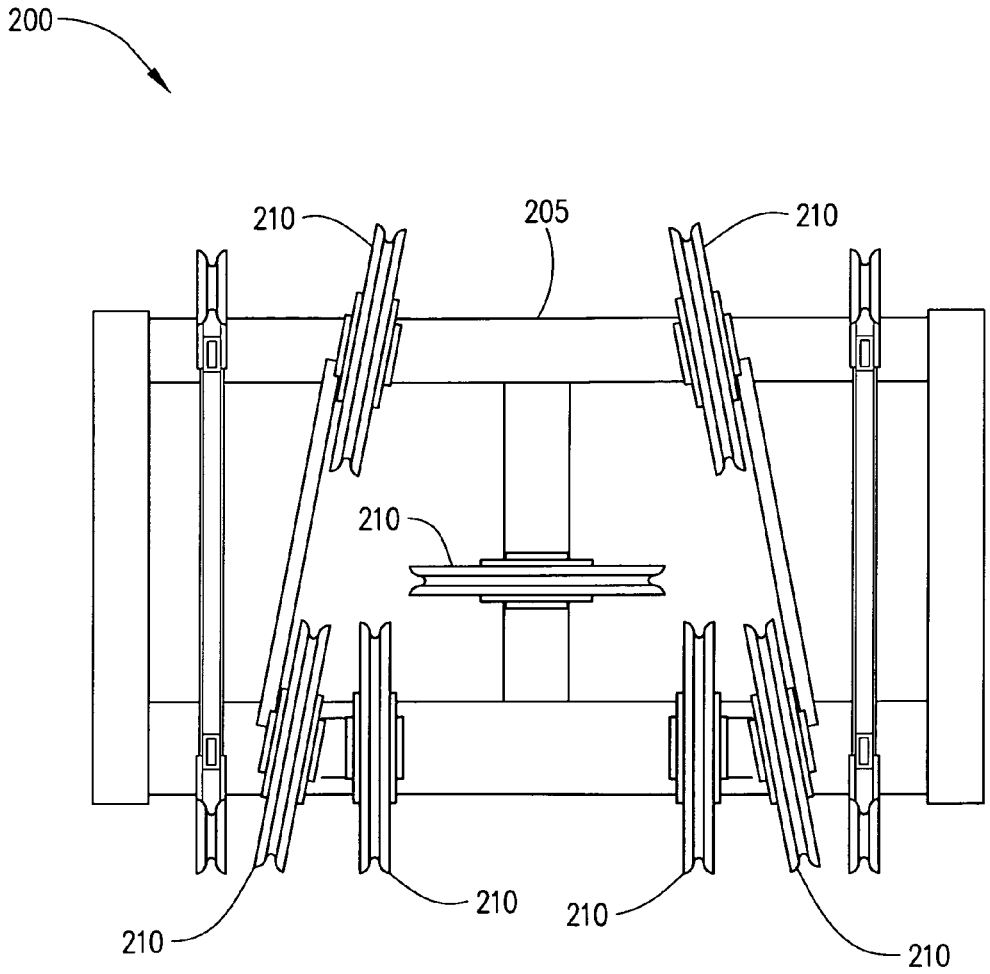
FIG. 11 is a top view of a crown pulley assembly utilized within the improved portable drilling apparatus.
Figure 12:
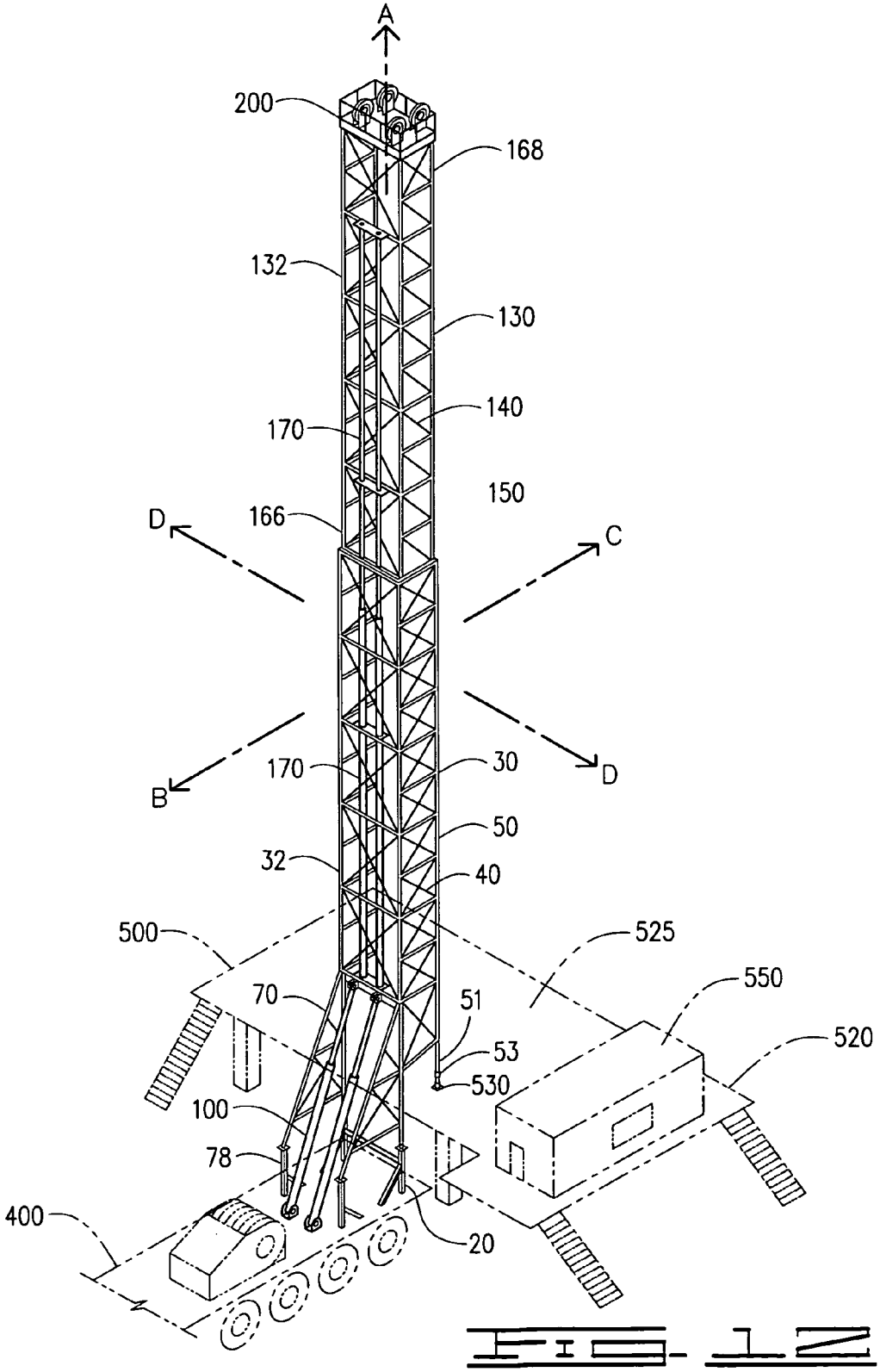
FIG. 12 is an isolated view of the upper derrick mast and lower derrick mast with at least one secondary hydraulic ram to raise and lower the upper derrick mast within the lower derrick mast and one primary hydraulic ram to raise and lower the lower mast.

An improved portable drilling apparatus 10 for the drilling of a vertical or horizontal oil or gas well using a vertical derrick with a top drive drilling and fluid assembly mounted upon a flat bed trailer 400 defining a trailer bed 402 supported by a trailer frame 404 and a flat profile rear end 405, the trailer frame supporting a cabling system and accessing an external electrical power plant and an external hydraulic pressure generating system for the erection and operation of the portable drilling apparatus 10, the improved portable drilling apparatus 10, demonstrated in FIGS. 1-14 of the drawings, comprising an improved rear base frame member 20 defining a pair of vertical rear support columns 22 with an upper end 23 providing an upper plate 24 and a pivotal mounting flange 25, a lower derrick mast 30 pivotally attached to the pivotal mounting flange 25 by a pin 36, the lower derrick mast 30 defining a pair of parallel rear legs 32 attached together with secondary support members 40 and a pair of shorter parallel front legs 50 attached by secondary support members 40 to each respective rear leg 32, with the area between each front leg open wherein the front legs 50 and rear legs 32 defining a channel 62, and a pair of diagonal A-frame support members 70 attached to each rear leg 32 extending away from each front leg 50, each diagonal A-frame support member 70 having a lower end 74, at least one primary hydraulic ram 100 attached between the lower derrick mast 30 and the trailer frame 404 to elevate and lower the lower derrick mast 30 from a horizontal transport position, FIGS. 1 and 12, to a vertical operational position FIG. 2, a pair of A-frame support stanchions 78 pivotally attached to the trailer frame 404 which may be raised into a support position below each lower end 74 of each respective diagonal A-frame support member 70 to lock the lower derrick mast 30 into the vertical operational position, and an upper derrick mast 130 slidably engaged within the channel 62 of the lower derrick mast 30, the upper derrick mast 130 defining two parallel rear legs 132 attached together by secondary support members 140, and a pair of front legs 150 of equal length to the rear legs 132, each front leg 150 attached to a respective rear leg 132 by additional secondary support members 140 with the space between the pair of front legs 150 open, wherein the rear legs 132 and front legs 150 of the upper derrick mast 130 also form a channel 162, the improved portable drilling apparatus 10 used in conjunction with an improved extendable drilling platform assembly 500.

Figure 6:
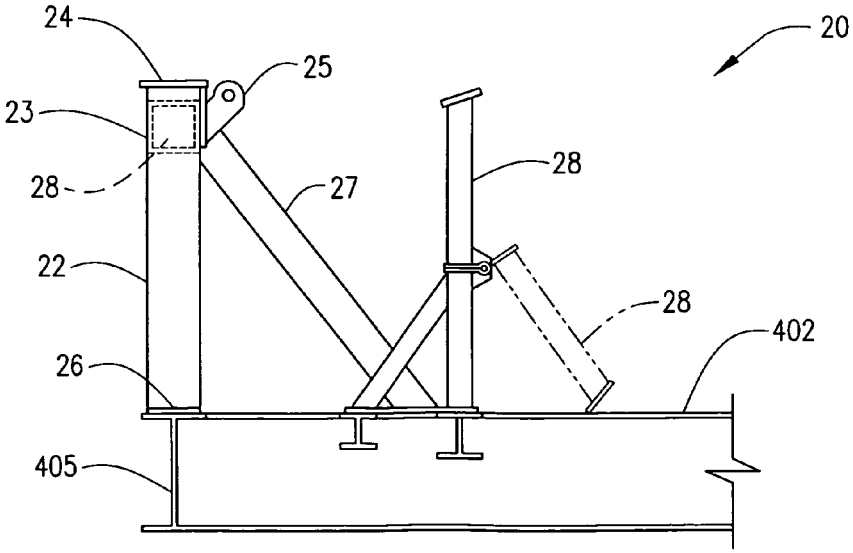
FIG. 6 is a side view of the rear base frame member of the improved portable drilling apparatus, with a phantom line representation of the A-frame support stanchion in a lowered position.

One of the most significant improvements to pivotal and portable derricks in the prior art lies in the presentation of the present improved portable drilling apparatus 10 having a low transport height provided by a higher substructure within the rear base frame member 20 and the pivotally attached lower derrick mast 30. This significantly increases the option of transporting the improved portable drilling apparatus upon public roadways due to the lower transport height without as much concern as being able to travel under most bridges and underpasses. As shown in FIG. 1, the overall transport height of the apparatus in the transport position is generally the height of the front legs 50 of the lower derrick mast 30. This is due to two present improvements, the first being the A-frame support member 70 being attached to the rear legs 32 of the lower derrick mast 30 which pivot over the top of the retracted A-frame support stanchion 78 during erection or takedown of the drilling apparatus, FIG. 6 shown in phantom line, with the A-frame support stanchion 78 extended, FIGS. 2, 6 and 12, to maintain the vertical erection and support to the drilling apparatus upon the trailer. The second improvement contributing to this lower transport height is the provision of the rear base frame member 20 providing a higher substructure with a smaller profile lower derrick mast 30, profile defining the distance between the front legs 50 and rear legs 32, and other components, reducing the overall transport height of the drilling apparatus, FIG. 1. As an even further improvement is the provision of the lower derrick mast 30 on the rear end 405 of the trailer 400 with shorter front legs 50 than the longer rear legs 32 with the intention of utilizing the improved portable drilling apparatus 10 with the extendable platform assembly 500, the front legs 50 being further attached to the secure attaching means 530 on the platform deck 520. Therefore, the lower derrick mast 30 utilizes the extendable platform deck 520 of the elevated platform assembly 500 setting upon solid ground to further support and secure the well side portion C of the portable drilling apparatus 10 instead of relying solely upon the trailer frame 404 for the entire support of the drilling apparatus 10, support for the drilling apparatus in the vertical operational position being distributed among primarily the rear legs 32 secured upon the rear base frame member 20 upon the trailer frame 404, secondarily by the A-frame support member 70 being held upward by the A-frame support stanchion 78 against the trailer frame 404, and thirdly, by the front legs 50 secured upon the raised extendable platform deck 520.

Figure 5:
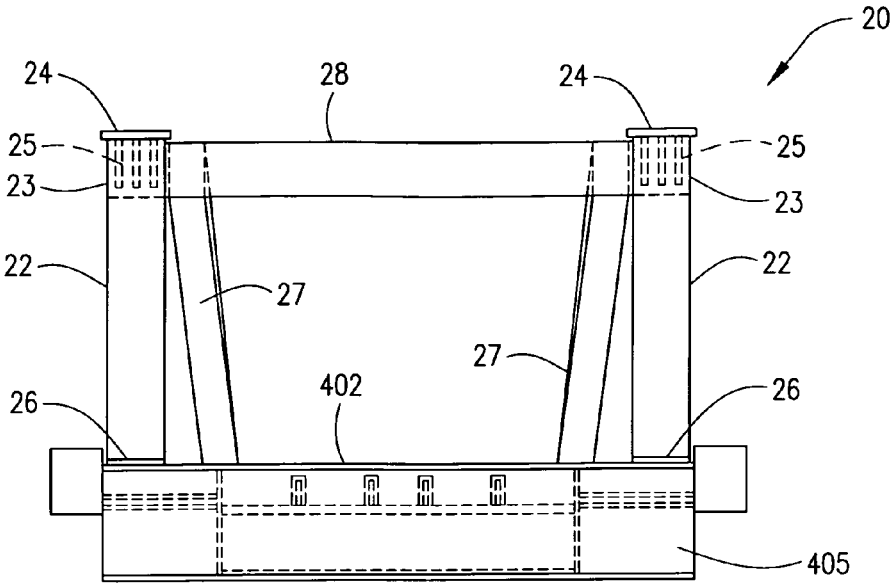
FIG. 5 is a rear view of a rear base frame member of the improved portable drilling apparatus.

The improved rear base frame member 20, FIGS. 5 and 6, further defines each rear support column 22 having a base end 26 attached to the trailer frame 404 at the rear end 405 of the trailer 400, the upper end 23 defining the upper plate 24 and pivotal mounting flange 25, a diagonal support member 27 attached between each support column 22 and the trailer frame 404 and an upper cross member 28 welded between each upper end 23 of each support column 22.

Figure 7A:
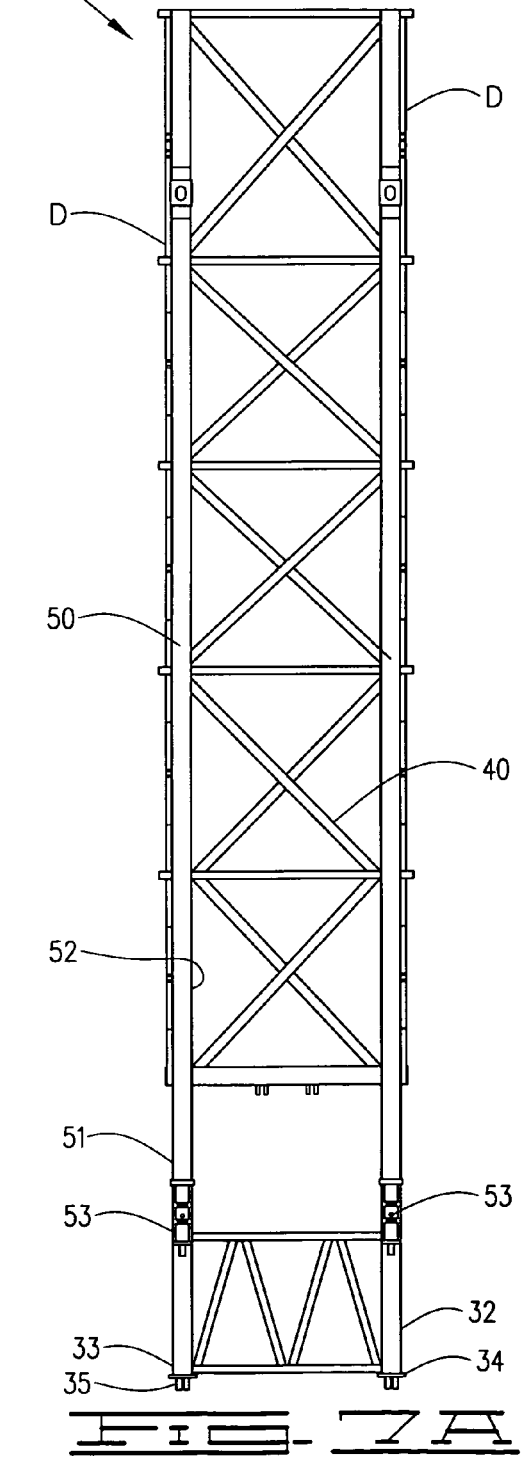
FIG. 7A is a well side view of a lower derrick mast within the improved portable drilling apparatus.
Figure 7B:
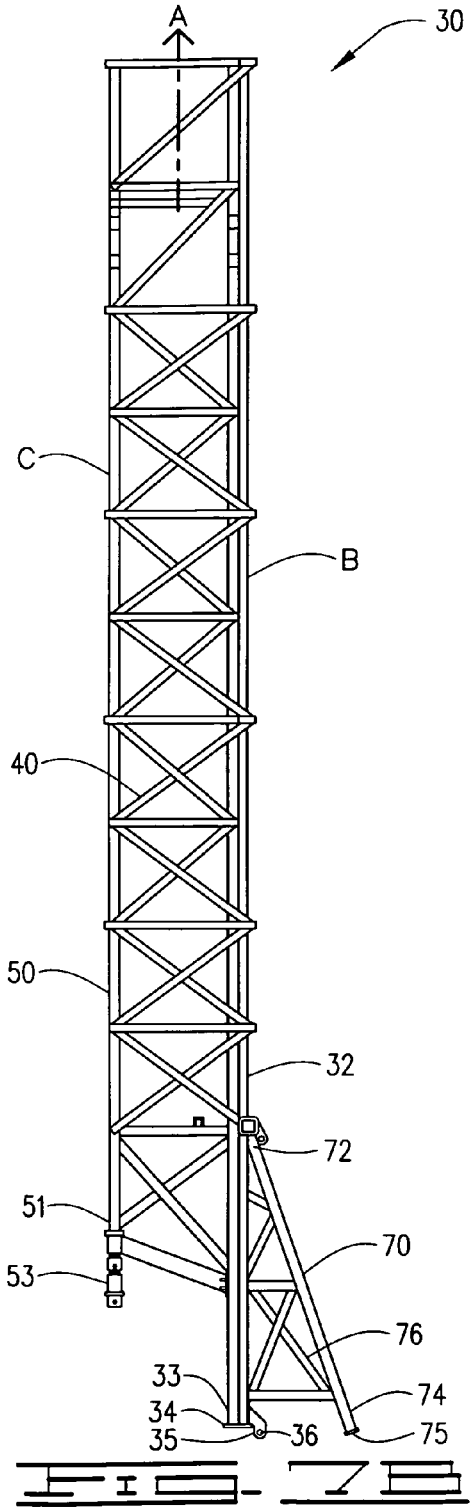
FIG. 7B is a lateral side view of the lower derrick mast.
Figure 6A:
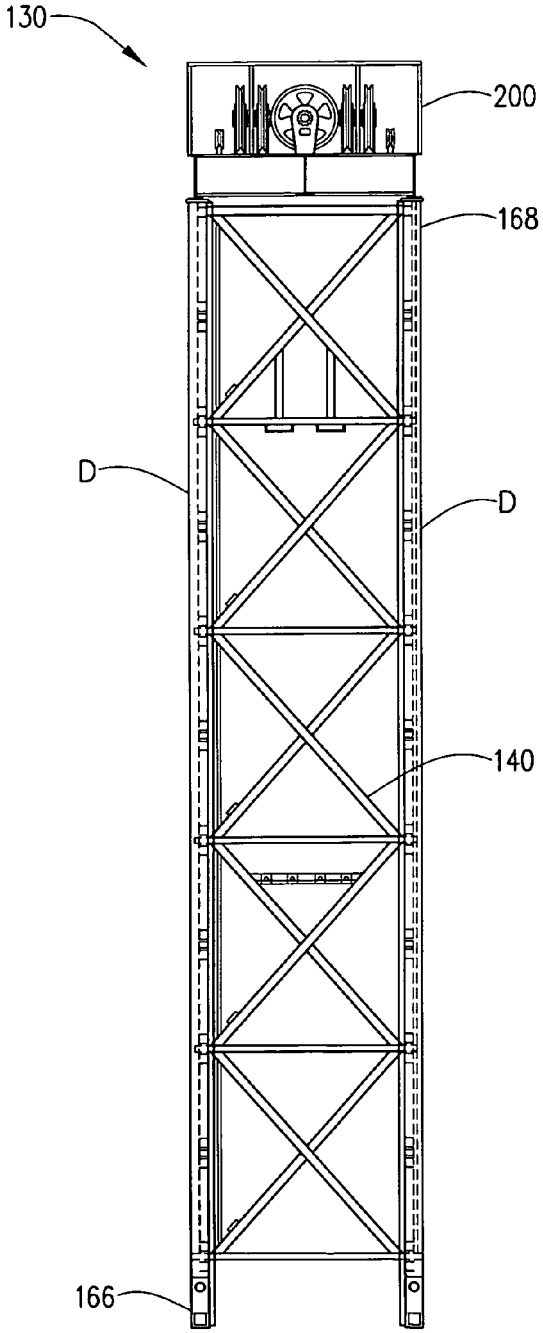
Figure 6B:
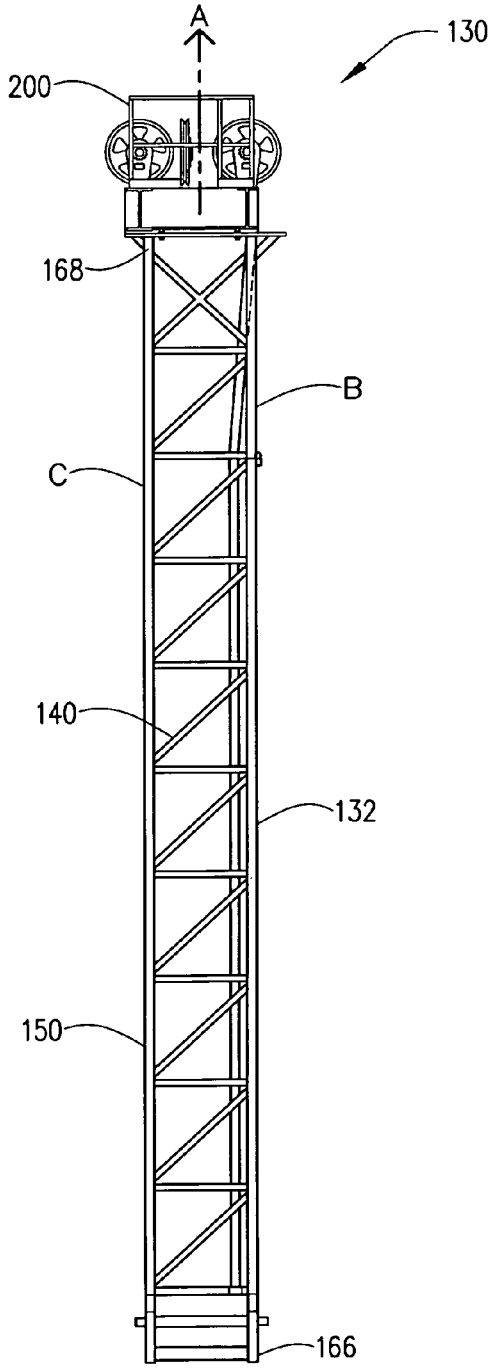
Figure 3A:
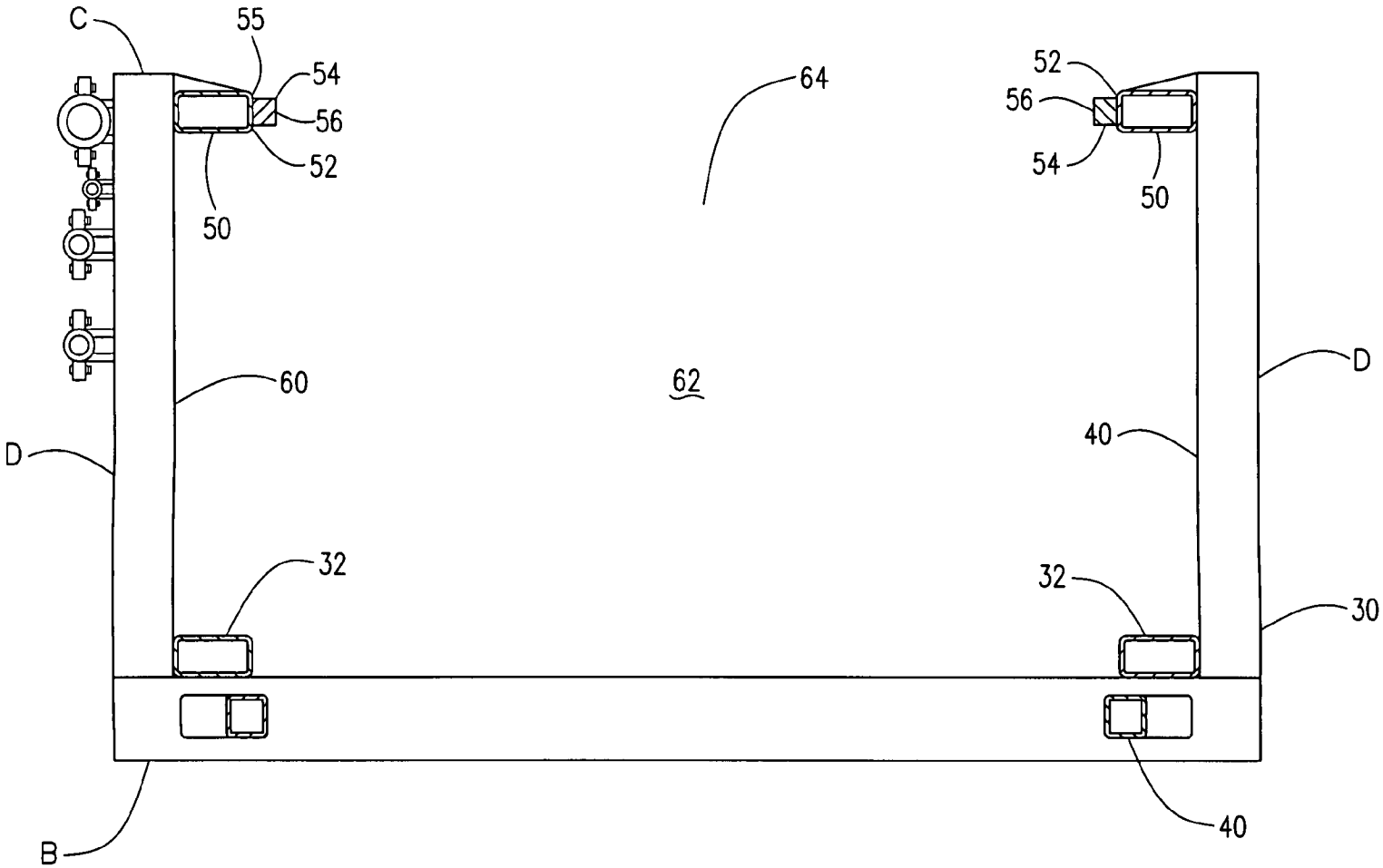
Figure 5B:
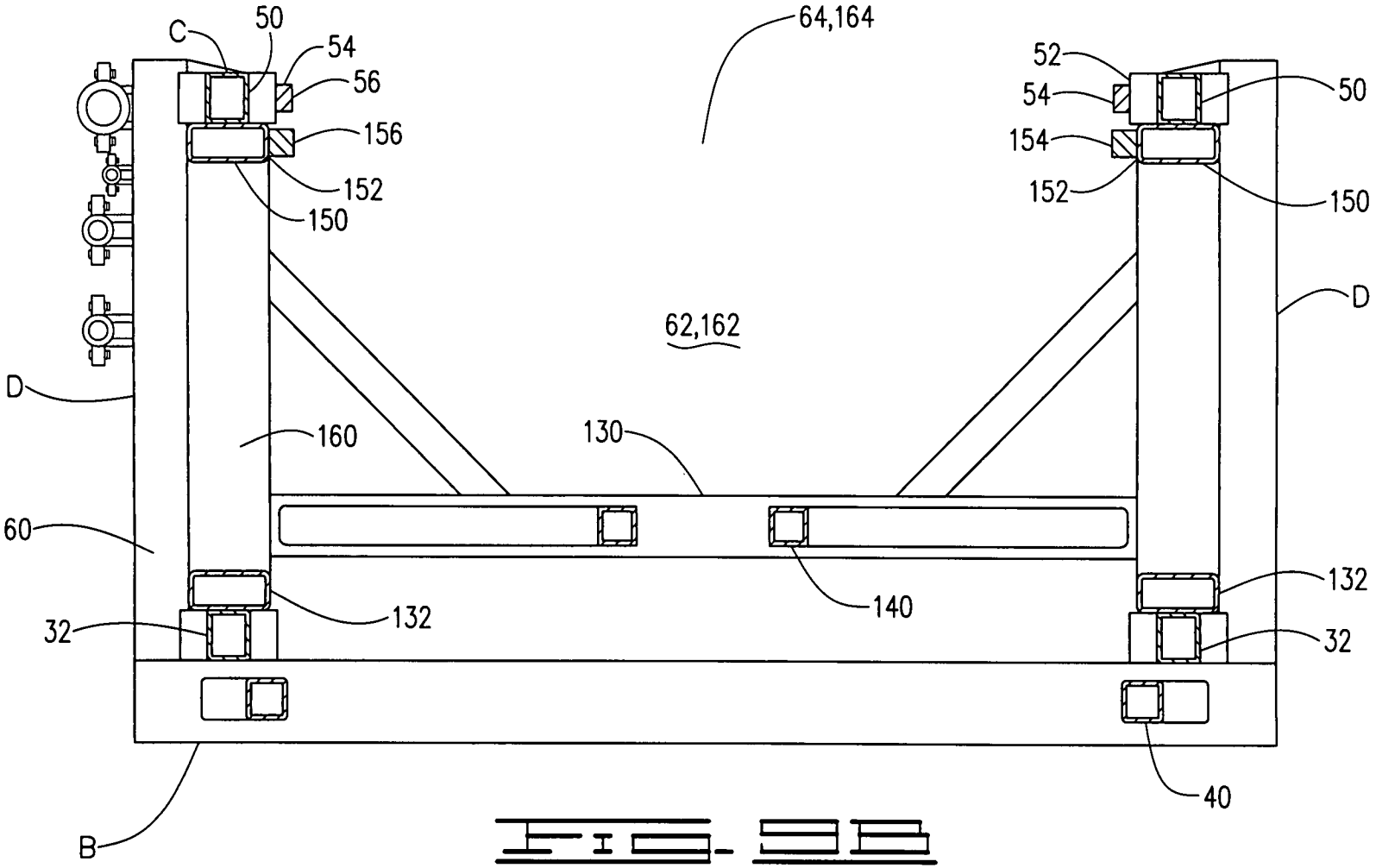
Figure 5C:
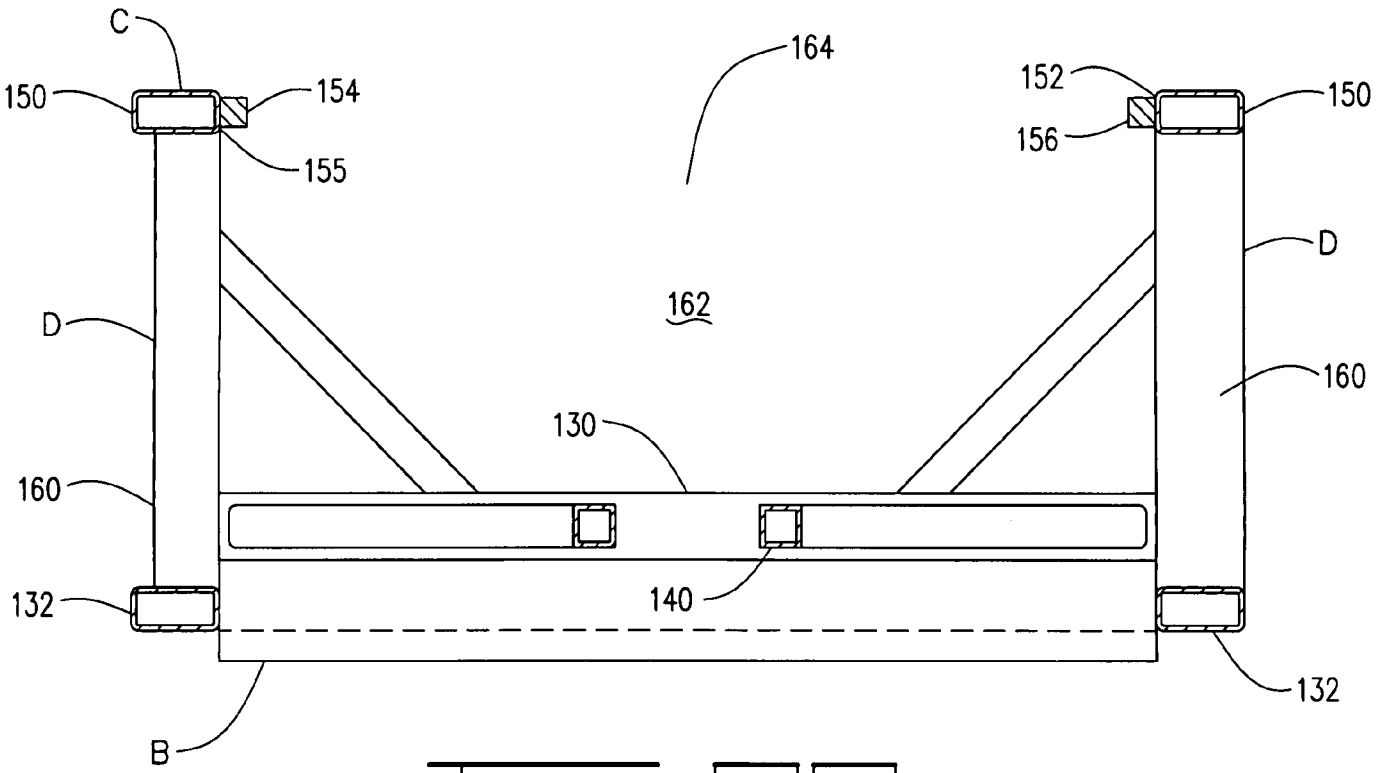
Figure 10:
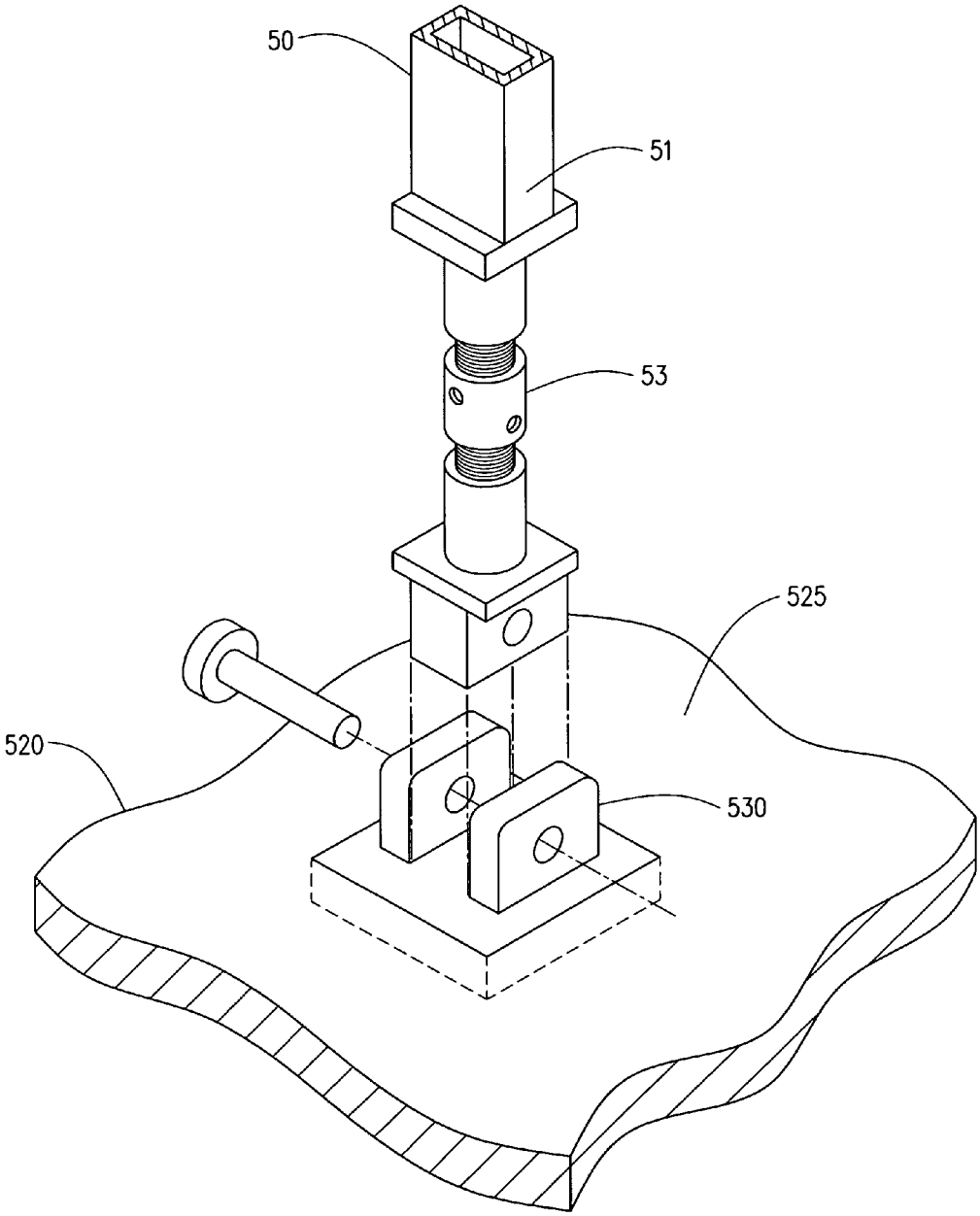
FIG. 10 is an isolated view of an adjustable component on the lower end of a front leg of the lower derrick mast and its relative attachment to a secure attaching means on an upper surface of the extendable platform deck of the extendable platform assembly.

The lower derrick mast 30, FIGS. 7A and 7B, further defines the two rear legs 32, two front legs 50 and secondary structural components 40 which support the rear legs 32 and front legs 50 forming a rectangular profile frame 60, FIG. 9A, defining a rig side portion B behind the rear legs 32, a well side portion C in front of the front legs 50 and two lateral side portions D between each adjacent front leg 50 and rear leg 32, with the well side portion C being the location for a channel opening 64 to the channel 62, the two rear legs 32 further defining a lower end 33 attaching a lower plate 34 and a lower extending pivotal mounting flange 35 engaging the respective aligned pivotal mounting flange 25 upon each rear support column 20 by a bolt or the pin 36, providing the lower derrick mast 30 pivotally engaged with the rear base frame member 20, the rear legs 32 being spaced apart the same distance as the support columns 22 wherein the upper plate 24 of the support columns provide support to the respective lower plates 34 on each rear leg 32 of the lower derrick mast 30 when the lower derrick mast 30 is in the elevated vertical operational position.

Each A-frame support member 70 extending behind from the lower derrick mast 30 opposite the front legs 50, FIGS. 2 and 7B, further defines an upper end 72 welded to the respective rear leg 30 and a lower end 74 defining a lower foot plate 75 terminating at an even horizontal level with the lower end 33 and lower plate 34 of the rear leg 32 with various secondary support members 76 attached between each A-frame support member 70 and the respective lower leg 32 of the lower derrick mast 30 with the pair of A-frame support stanchions 78 pivotally attached to the trailer frame 404 elevating upward from the trailer frame 404 and locking into a vertical position below the respective lower foot plates 75 of each A-frame support 70 to provide additional locking support to the lower derrick mast 30 in the elevated vertical operational position.

The upper derrick mast 130 defining two rear legs 132, two front legs 150 and various secondary support members 140 which support the rear legs 132, FIGS. 8A and 8B, also form a rectangular profile frame 160, FIG. 9C, also defining a rig side portion B behind the rear legs 132, a well side portion C in front of the front legs 150 and two lateral side portions D between each adjacent front leg 150 and rear leg 132, the front legs 150 defining a channel opening 164 on the well side C of the channel 162, the rectangular profile frame 160 of upper derrick mast 130 being smaller in diameter than the rectangular profile frame 60 of the lower derrick mast 30 wherein the upper derrick mast 130 is slidably engaged within the lower derrick mast 30 in a telescoping manner with the open channels 32, 162 of the upper and lower derrick masts both being open towards the rig side B, FIG. 9B, the upper derrick mast 130 being raised and lowered by at least one secondary hydraulic ram 170, FIG. 12, provided within the channel 62 between a lower end 166 of the upper derrick mast 130 and the lower derrick mast 30 forcing the upper derrick mast 130 from within the channel 62 of the lower derrick mast 30 and extending an upper end 168 of the upper derrick mast 130 above the lower derrick mast 30 while in the raised vertical operational position. The upper derrick mast 130 further defines the upper end 168 supporting a crown pulley assembly 200 comprising a frame 205 and a series of cable pulleys 210 through which a cable is utilized to raise and lower a top drive assembly 300 with the channels 62, 162 of the upper and lower derrick masts 30, 130 during drilling operations performed by the improved portable drilling apparatus 10.

Figure 3:
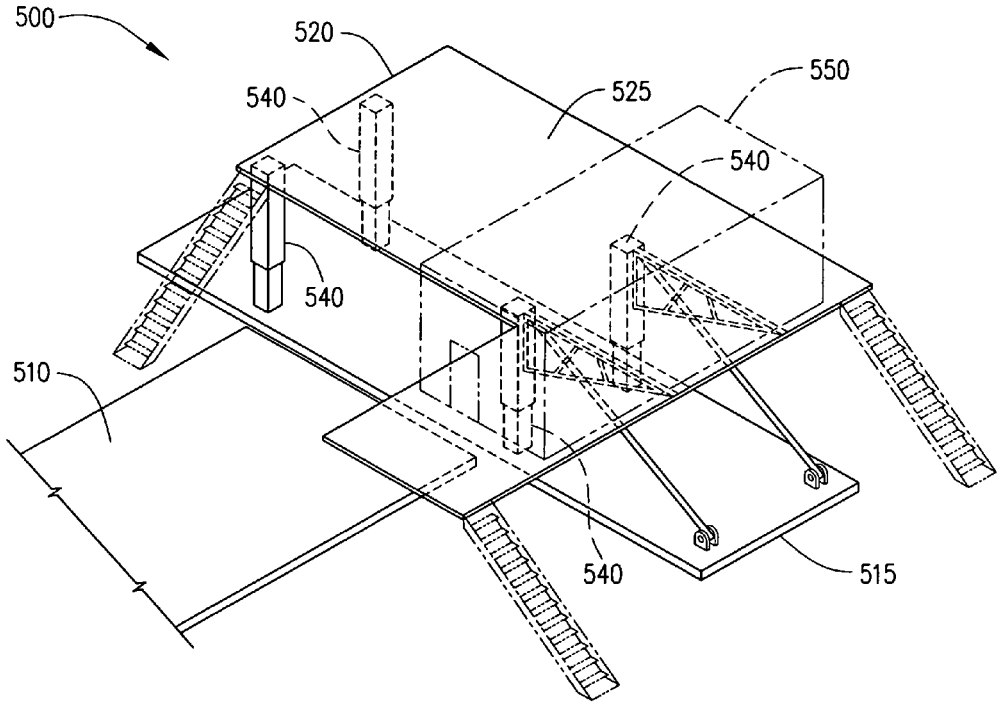
FIG. 3 is an upper perspective view of an embodiment of an extendable platform base to be used with the improved portable drilling apparatus, with phantom lines indicating secondary support elements.
Figure 4:
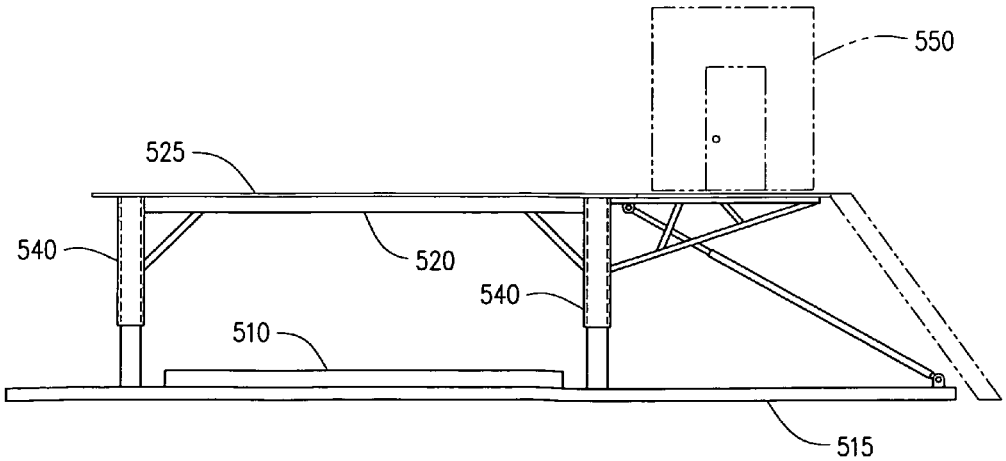
FIG. 4 is a side view of the extendable platform base with phantom lines indicating secondary support elements.

It is preferred that the improved portable drilling apparatus 10 be utilized in conjunction with an extendable elevating platform assembly 500, FIGS. 3 and 4, constituting a further improvement to the support and operation of the drilling apparatus, the platform assembly 500 providing a trailer support plate 510 securing to an extendable platform deck 520, FIGS. 2 and 3, forming a T-shaped support base 515, the trailer support plate 510 lying flat upon the prepared ground surface, and providing the flat and level support structure upon which the portable drilling apparatus 10 is set throughout the entire drilling, completion and other operations of the portable drilling apparatus 10 and operational apparatus are conducted. The extendable platform deck 500 further is set with the rear end 405 of the trailer 400, FIG. 2, upon which the improved portable drilling apparatus 10 is secured, the rear end 405 aligned below the adjacent extendable platform deck 520, the deck further defining an upper surface 525 having a secure attaching means 530 for the secure attachment of a lower end 51 of the front legs 50 of the lower derrick mast 30 resting thereon, FIG. 10, which further stabilizes the trailer 400 and portable drilling apparatus 10 during drilling operations by locking the front legs 50 into position upon the platform deck 520. This extendable elevating platform assembly 500 reduces the need to stabilize the surface underneath the trailer 400 and derrick assembly 10 once the trailer support plate is 510 placed upon the prepared level and stable ground surface. These components and their orientation are shown in FIGS. 2-4 and 12.

The extendable platform deck 520 further comprises four extending hydraulic support members 540 which elevate the extendable platform deck 520 into a raised operational position, FIG. 2, and lowered into a transport position, by a hydraulic means. The elevated platform deck 520, providing several necessary openings, accessory structures and components required for the drilling and completion of a well, is extended to a height above the ground of approximately fifteen feet, which is a generous height under which equipment and material can be supplied below the elevated platform, with protection underneath to those involved in the operation from the overhead activity. It also provides ample space for the completion process which often requires the placement of heavy valves and pipes using heavy construction equipment for the recovery of the product withdrawn from the well. The T-shaped support base 515 increases the distribution of forces generated by the derrick assembly 10 during operation, assembly and removal. As indicated before, it also provides a stable mounting surface for an operational and control enclosure 550 and the very few workers required to conduct operations, which the improved portable drilling apparatus and the extendable elevating platform assembly reducing the exposure of employees to the platform deck during drilling operations, most activity being controlled by a single operator in the control enclosure. The platform assembly would further provides the operational and control enclosure with a detachable staircase for an operator to ascend into the control enclosure from the ground with the operational and control enclosure situated in a position where the drilling operation can be viewed during operations.

In addition to the disclosed features of the trailer 400, the rear base frame member 20, and the telescoping lower and upper derrick masts 30, 160, the improved portable drilling apparatus further comprises the crown pulley assembly 200 located at the upper end 168 of the upper derrick mast 130, as indicated in FIGS. 1, 2 and 11, which is used in conjunction with a single cable attached to the cabling system located on the trailer. The cabling system, the cable and the crown pulley assembly 200 are used during the drilling operation to raise and lower a standard or an improved top drive assembly 300 with the portable drilling apparatus 10, the improved top drive assembly 300 integrated with the upper and lower derrick masts 30, 130 within the channels 62, 162, and raised and lowered within the channels by the cable over the series of pulleys 210 within the crown pulley assembly 200, controlled by the cabling system by the operator within the control enclosure.

Figure 13:
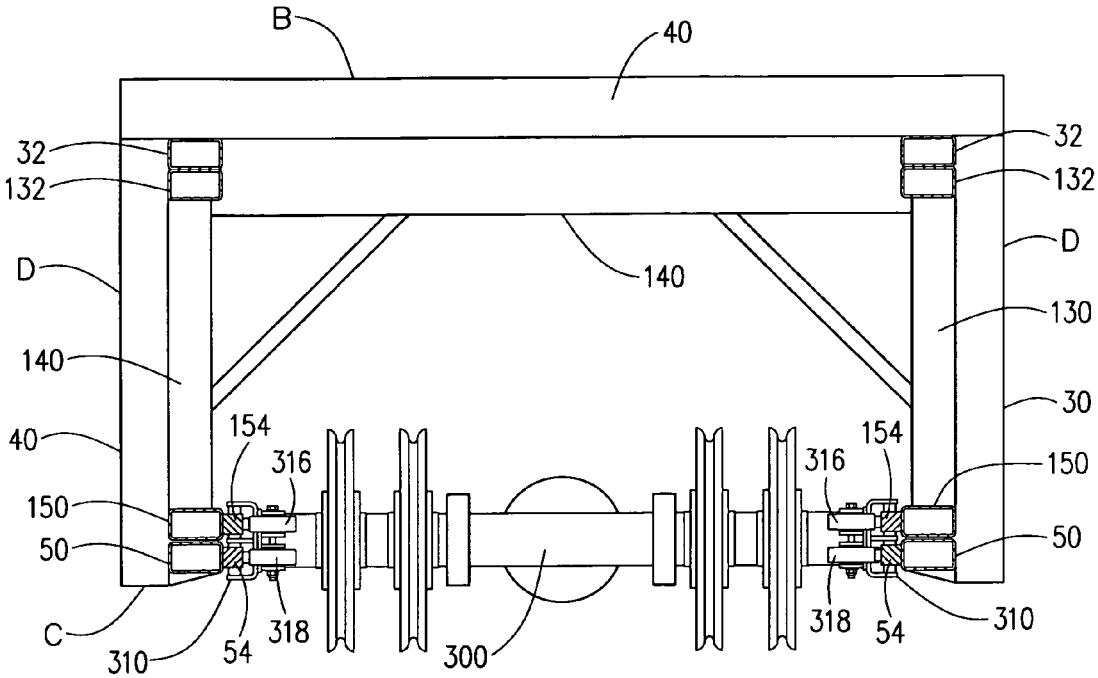
FIG. 13 is a top view of the FIG. 9B which includes a top drive assembly as utilized within the improved portable drilling apparatus.
Figure 14:
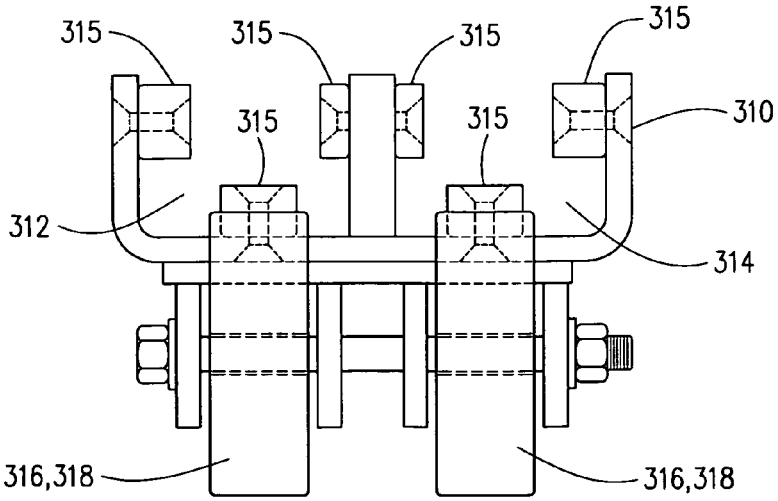
FIG. 14 is a top sectional view of a guide track of the top drive assembly for use within the improved portable drilling apparatus.

The improved top drive assembly 200, FIG. 13, while more specifically disclosed and claimed under separate patent, provides the top drive 200 with opposing lateral dual channel guide tracks 310 which are guided along singular guide rails 54, 154, each guide rail 54, 154, having a rear surface 55, 155, attached upon respective inner facing surfaces 52, 152, of the front legs 50, 150, of the upper and lower derrick masts 30, 130, within the channel 62, 162, the guide rails 54, 154, of the lower derrick mast 30 and upper derrick mast 130 being aligned parallel, with a section of the guide rails of the lower derrick mast and the upper derrick mast overlapping where the upper and lower derrick masts overlap during full extension, again FIG. 13, the dual channel guide tracks 310 of the top drive 300 providing a secure transaction and transfer between the guide rails 54, 154 of the lower and upper derrick masts 30, 130. The improvement over prior top drive assemblies lies within the lateral dual channel guide tracks 310, FIG. 14, defining first and second channel guide segments 312, 314, aligned in parallel with a friction reducing lining 315 and also having adjustable upper and lower guide track wheels 316, 318, which ride upon inner facing surfaces 56, 156 of the guide rails 54, 154, providing a much smoother ride of the top drive assembly 300 within the channels 62, 162, requiring less force to move the top drive assembly 300 up and down the channels 62, 162, to improve the secure lateral stability of the top drive assembly 300, and to reduce wear and tear of the dual channel guide tracks 310 and the guide rails 54, 154 during repeated use.

The significant operational performance capacity is realized by the improvement of the present portable drilling assembly 10 due to the enhanced support of the rear base frame member 20, the A-frame support 70, and the A-frame support stanchions 78, which not only provide additional base support to the drilling apparatus but also provide the drilling apparatus with the capacity to increase the amount of drilling torque which can be applied to the drilling operations. In this regard, when the lower derrick mast 30 is elevated into the vertical drilling position by the at least one hydraulic ram 100, the hydraulic ram 100 will provide the ability to move the lower derrick mast 30 beyond a vertical position and actually push the lower mast somewhat forward of a vertical axis A towards the well side C and the extendable platform assembly 500. Once the lower derrick mast 30 is extended, the A-frame support stanchions 78 are put into position below the lower foot plates 75 of the A-frame support members 70 to maintain this forward projection of the lower and upper derrick masts 30, 130, during drilling operations with at least 60% of the weight of the drilling assembly 10 on the well side C, further held in position by the attachment of the lower end 51 of the front legs 50 to the secure attaching means 530 on the upper surface 525 of the extendable platform deck 520, which involves some preferred adjustable components 53 for final positioning of the lower derrick mast 30 to a preferred stable position prior to the commencement of drilling operations in conjunction with the stabilization of the lower foot plate 75 of the lower end 74 of each A-frame support 70 by the placement of each A-frame support stanchion 78 below each lower foot plate 75.

One of the most significant improvements to pivotal and portable derricks in the prior art lies in the presentation of the present improved portable drilling apparatus 10 having a low transport height provided by a higher substructure within the rear base frame member 20 and the pivotally attached lower derrick mast 30. This significantly increases the option of transporting the improved portable drilling apparatus upon public roadways due to the lower transport height without as much concern as being able to travel under most bridges and underpasses. As shown in FIG. 1, the overall transport height of the apparatus in the transport position is generally the height of the front legs 50 of the lower derrick mast 30. This is due to two present improvements, the first being the A-frame support member 70 being attached to the rear legs 32 of the lower derrick mast 30 which pivot over the top of the retracted A-frame support stanchion 78 during erection or takedown of the drilling apparatus, FIG. 6 shown in phantom line, with the A-frame support stanchion 78 extended, FIGS. 2, 6 and 12, to maintain the vertical erection and support to the drilling apparatus upon the trailer. The second improvement contributing to this lower transport height is the provision of the rear base frame member 20 providing a higher substructure with a smaller profile lower derrick mast 30, profile defining the distance between the front legs 50 and rear legs 32, and other components, reducing the overall transport height of the drilling apparatus, FIG. 1. As an even further improvement is the provision of the lower derrick mast 30 on the rear end 405 of the trailer 400 with shorter front legs 50 than the longer rear legs 32 with the intention of utilizing the improved portable drilling apparatus 10 with the extendable platform assembly 500, the front legs 50 being further attached to the secure attaching means 530 on the platform deck 520. Therefore, the lower derrick mast 30 utilizes the extendable platform deck 520 of the elevated platform assembly 500 setting upon solid ground to further support and secure the well side portion C of the portable drilling apparatus 10 instead of relying solely upon the trailer frame 404 for the entire support of the drilling apparatus 10, support for the drilling apparatus in the vertical operational position being distributed among primarily the rear legs 32 secured upon the rear base frame member 20 upon the trailer frame 404, secondarily by the A-frame support member 70 being held upward by the A-frame support stanchion 78 against the trailer frame 404, and thirdly, by the front legs 50 secured upon the stationary extendable platform assembly 500.

While the improved portable drilling apparatus 10 has been particularly shown and described with reference to a preferred embodiment thereof, it will be understood by those skilled in the art that changes in form and detail may be made therein without departing from the spirit and scope of the improvements to the portable drilling apparatus 10.

What is claimed is:

1. An improved portable drilling apparatus for drilling a vertical or horizontal oil or gas well using a vertical derrick with a top drive drilling and fluid assembly mounted upon a trailer which includes a trailer bed supported upon a trailer frame and defines a flat profile rear end, with a cabling system mounted upon said trailer bed, said improved portable drilling apparatus comprising:

an improved rear base frame member defining a pair of vertical rear support columns with an upper end providing an upper plate and a pivotal mounting flange;

a lower derrick mast pivotally attached to said pivotal mounting flanges by pins, said lower derrick mast defining a pair of parallel rear legs attached together with secondary support members and a pair of shorter parallel front legs attached by secondary support members to each respective rear leg, with an area between each front leg open, wherein said front legs and rear legs define a channel;

a pair of diagonal A-frame support members respectively attached to each rear leg extending away from each front leg, each diagonal A-frame support member having a lower end;

at least one primary hydraulic ram attached between said lower derrick mast and said trailer frame to elevate and lower said lower derrick mast from a horizontal transport position to a vertical operational position;

a pair of A-frame support stanchions pivotally attached to said trailer frame which are raised into a support position below each lower end of each respective diagonal A-frame support member to lock said lower derrick mast into said vertical operational position; and an upper derrick mast slidably engaged within said channel of said lower derrick mast, said upper derrick mast defining two parallel rear legs attached together by secondary support members, and a pair of front legs of equal length to said rear legs, each front leg attached to a respective rear leg by additional secondary support members with an area between said pair of front legs open, wherein said rear legs and front legs of said upper derrick mast also forming a channel.

2. The improved portable drilling apparatus as disclosed in claim 1, further comprising:

each rear support column of said improved rear base frame member having a base end attached to said trailer frame at said rear end of said trailer, said upper end defining said upper plate and pivotal mounting flange, a diagonal support member attached between each support column and said trailer frame and an upper cross member welded between each upper end of each support column; and said lower derrick mast further defines said two rear legs, two front legs and secondary structural components which support said rear legs and front legs forming a rectangular profile frame defining a rig side portion behind said rear legs, a well side portion in front of said front legs and two lateral side portions between each adjacent front leg and rear leg, with said well side portion defining a channel opening to said channel, said two rear legs further defining a lower end attaching a lower plate and a lower extending pivotal mounting flange engaging said respective aligned pivotal mounting flanges upon each rear support column by bolts or pins, providing said lower derrick mast pivotally engaged with said rear base frame member, said rear legs being spaced apart equal to said support columns wherein said upper plate of said support columns provide support to said respective lower plates on each rear leg of said lower derrick mast when said lower derrick mast is in said elevated vertical operational position.

3. The improved portable drilling apparatus as disclosed in claim 1, each said A-frame member further comprising:

an upper end welded to said respective rear leg and a lower end defining a lower foot plate terminating at an even horizontal level with a lower end and a lower plate of said rear leg with a plurality of secondary support members attached between each A-frame support member and said respective lower leg of said lower derrick mast with said pair of A-frame support stanchions pivotally attached to said trailer frame elevating upward from said trailer frame and locking into a vertical position below said respective lower foot plates of each A-frame support to provide additional locking support to said lower derrick mast in said elevated vertical operational position.

4. The improved portable drilling apparatus as disclosed in claim 1, further comprising:

each rear support column of said improved rear base frame member having a base end attached to said trailer frame at said rear end of said trailer, said upper end defining said upper plate and pivotal mounting flange, a diagonal support member attached between each support column and said trailer frame and an upper cross member welded between each upper end of each support column;

said lower derrick mast further defines said two rear legs, two front legs and secondary structural components which support said rear legs and front legs forming a rectangular profile frame defining a rig side portion behind said rear legs, a well side portion in front of said front legs and two lateral side portions between each adjacent front leg and rear leg, with said well side portion defining a channel opening to said channel, said two rear legs further defining a lower end attaching a lower plate and a lower extending pivotal mounting flange engaging said respective aligned pivotal mounting flanges upon each rear support column by bolts or pins, providing said lower derrick mast pivotally engaged with said rear base frame member, said rear legs being spaced apart equal to said support columns wherein said upper plate of said support columns provide support to said respective lower plates on each rear leg of said lower derrick mast when said lower derrick mast is in said elevated vertical operational position; and each said A-frame member further comprising an upper end welded to said respective rear leg and a lower end defining a lower foot plate terminating at an even horizontal level with said lower end and said lower plate of said rear leg with a plurality of secondary support members attached between each A-frame support member and said respective lower leg of said lower derrick mast with said pair of A-frame support stanchions pivotally attached to said trailer frame elevating upward from said trailer frame and locking into a vertical position below said respective lower foot plates of each A-frame support to provide additional locking support to said lower derrick mast in said elevated vertical operational position.

5. The improved portable drilling apparatus as disclosed in claim 1, further comprising:

said lower derrick mast further defines said two rear legs, two front legs and secondary structural components which support said rear legs and front legs forming a rectangular profile frame defining a rig side portion behind said rear legs, a well side portion in front of said front legs and two lateral side portions between each adjacent front leg and rear leg, with said well side portion defining a channel opening to said channel, said two rear legs further defining a lower end attaching a lower plate and a lower extending pivotal mounting flange engaging said respective aligned pivotal mounting flanges upon each rear support column by bolts or pins, providing said lower derrick mast pivotally engaged with said rear base frame member, said rear legs being spaced apart equal to said support columns wherein said upper plate of said support columns provide support to said respective lower plates on each rear leg of said lower derrick mast when said lower derrick mast is in said elevated vertical operational position; and said upper derrick mast further defining two rear legs, two front legs and a plurality of secondary support members which support said rear legs, forming a rectangular profile frame and defining a rig side portion behind said rear legs, a well side portion in front of said front legs and two lateral side portions between each adjacent front leg and rear leg, said front legs defining a channel opening on said well side said channel, said rectangular profile frame of upper derrick mast being smaller in diameter than said rectangular profile frame of said lower derrick mast wherein said upper derrick mast is slidably engaged within said lower derrick mast in a telescoping manner with said open channels of said upper and lower derrick masts both being open towards said rig side, said upper derrick mast being raised and lowered by at least one secondary hydraulic ram provided within said channel between a lower end of said upper derrick mast and said lower derrick mast forcing said upper derrick mast from within said channel of said lower derrick mast and extending an upper end of said upper derrick mast above said lower derrick mast while in said raised vertical operational position, said upper derrick mast further defining said upper end supporting a crown pulley assembly comprising a frame and a series of cable pulleys through which a cable is utilized to raise and lower a top drive assembly with said channels of said upper and lower derrick masts during drilling operations performed by said improved portable drilling apparatus.

6. The improved portable drilling apparatus as disclosed in claim 1, further comprising:

said lower derrick mast further defines said two rear legs, two front legs and secondary structural components which support said rear legs and front legs forming a rectangular profile frame defining a rig side portion behind said rear legs, a well side portion in front of said front legs and two lateral side portions between each adjacent front leg and rear leg, with said well side portion defining a channel opening to said channel, said two rear legs further defining a lower end attaching a lower plate and a lower extending pivotal mounting flange engaging said respective aligned pivotal mounting flanges upon each rear support column by bolts or pins, providing said lower derrick mast pivotally engaged with said rear base frame member, said rear legs being spaced apart equal to said support columns wherein said upper plate of said support columns provide support to said respective lower plates on each rear leg of said lower derrick mast when said lower derrick mast is in said elevated vertical operational position; and each said A-frame member further comprising an upper end welded to said respective rear leg and a lower end defining a lower foot plate terminating at an even horizontal level with said lower end and said lower plate of said rear leg with a plurality of secondary support members attached between each A-frame support member and said respective lower leg of said lower derrick mast with said pair of A-frame support stanchions pivotally attached to said trailer frame elevating upward from said trailer frame and locking into a vertical position below said respective lower foot plates of each A-frame support to provide additional locking support to said lower derrick mast in said elevated vertical operational position, wherein said at least one hydraulic ram is extended to push said lower derrick mast beyond a vertical axis towards said well side and said A-frame support stanchions are positioned below said lower foot plates of said A-frame support members to maintain a forward projection of said lower mast, placing at least 60% of a relative mass of said improved drilling apparatus directed towards said well side of said vertical axis of said apparatus.

7. The improved portable drilling apparatus as disclosed in claim 1, wherein said improved portable drilling apparatus is operated in conjunction with an extendable elevated platform assembly, said platform assembly comprising:

a trailer support plate securing to a T-shaped support base, said trailer support plate lying flat upon prepared ground for a flat and level support upon which said portable drilling apparatus is set throughout a process of drilling, completion and other operations of said portable drilling apparatus and operational apparatus are conducted, said T-shaped base vertically aligning said rear end of said trailer upon which said improved portable drilling apparatus is secured;

an extendable platform deck set upon said T-shaped base, said platform deck further defining an upper surface having a secure attaching means for a secure attachment of a lower end of said front legs of said lower derrick mast resting thereon, which further stabilizes said trailer and portable drilling apparatus during drilling operations by locking said front legs into position upon said platform deck and four extending hydraulic support members which elevate said extendable platform deck into a raised operational position, and lowered into a transport position, by a hydraulic means, said elevated platform deck additionally providing a plurality of openings, accessory structures and components required for the process of drilling and completion of a well, wherein said platform deck is extended to a height above ground surface below of approximately fifteen feet, under which equipment and material can be supplied below said elevated platform, said elevated deck providing protection underneath to those involved in operational tasks from overhead activity and providing ample space for completion processes during which placement of heavy valves and pipes using heavy construction equipment for recovery of drilling products withdrawn from the well are required, whereby support for said drilling apparatus in said vertical operational position is distributed among primarily said rear legs secured upon the rear base frame member upon said trailer frame, secondarily by said A-frame support member supported by said A-frame support stanchion against said trailer frame, and thirdly, by said front legs secured upon said raised extendable platform deck.

8. The improved portable drilling apparatus as disclosed in claim 1, further comprising said horizontal transport position defining a low overall transport height determined by said trailer bed, said rear support columns within said rear base frame member and said rear and front legs of said lower derrick mast, with said A-frame support member being attached to said rear legs, enabling said A-frame support member to swing below said upper end of said rear base frame member during positioning from said horizontal transport position into said vertical operational position, resulting in greater transport options for said improved portable drilling apparatus on public roadways, bridges and underpasses.

* * * * *